US005188016A

United States Patent [19]

Tung

[11] Patent Number: 5,188,016

[45] Date of Patent: Feb. 23, 1993

[54] CYLINDER STRUCTURE FOR A PNEUMATICALLY OPERATED TOOL

[76] Inventor: Fung-Eng Tung, No. 46, Lane 1181, Fung Shih Road, Pu Tze Li, 1 Lin, Fung Yuan City, Taichung Hsien, Taiwan

[21] Appl. No.: 857,157

[22] Filed: Mar. 25, 1992

[51] Int. Cl.[5] ..... F15B 15/22

[52] U.S. Cl. ..... 91/408; 91/409; 92/85 B

[58] Field of Search ..... 92/85 B, 107; 91/22, 91/399, 402, 405, 407, 408, 409

[56] References Cited

U.S. PATENT DOCUMENTS

| | | | |
|---|---|---|---|
| 3,205,787 | 9/1965 | Volkman | 91/399 |
| 3,805,672 | 4/1974 | Pekrul | 92/85 B |
| 3,834,276 | 9/1974 | Gournelle | 92/85 B |
| 4,397,220 | 8/1983 | Russo et al. | 92/85 B |

FOREIGN PATENT DOCUMENTS

| | | | |
|---|---|---|---|
| 0115608 | 9/1980 | Japan | 92/85 B |
| 1022489 | 3/1966 | United Kingdom | 92/85 B |

*Primary Examiner*—Thomas E. Denion
*Attorney, Agent, or Firm*—Browdy and Neimark

[57] ABSTRACT

An improved cylinder structure for a pneumatically operated tool, which is characterized in the two air tight chambers defined at the front and rear ends of the cylinder so that the air confined therein can produce reaction pressure respectively to reduce the operation speed of the piston when it approaches the dead ends of the cylinder and further to bounce back the same in a rapid manner whereby the impact of the moving piston can be effectively reduced at the dead ends and the noise and vibration generated as a result of high speed impact on the ends of the cylinder can also be minimized; moreover, the piston can be protected from being deformed and damaged due to constant direct impacts.

1 Claim, 3 Drawing Sheets

CYLINDER STRUCTURE FOR A PNEUMATICALLY OPERATED TOOL

FIELD OF THE INVENTION

The present invention is related to an improved cylinder structure for a pneumatically operated tool, which is mainly characterized in the formation of two air tight chambers at the front and rear ends of the cylinder when the piston thereof is pushed to the dead ends during the expansion and compression strokes whereby buffer or damper-like effect can be established due to the compressed air confined in the so formed air tight chambers so that the high speed impact on the cylinder ends by the piston can be reduced to a minimum degree. Such improvement on the cylinder structure can effectively reduce the operation noise and vibration and wearing condition, and so is the output power of the cylinder also accordingly increased.

In other words, the air tight chambers so produced can generate a buffer effect and sever as a damper when the piston make a direct impact on the top dead ends of the cylinder due to the reaction pressure produced in the chambers.

The prior art pneumatically operated tool, as shown in FIGS. 1, 2, mainly comprises a valve body 10 which accommodates a movable valve 11 therein that can be operated in association with a number of air passage holes so that the valve 11 can be accordingly moved by input compressed air to vary the course of the compressed air flow; a cylinder head plate 15 disposed in front of the valve body 10 having an air passage 16 for the communication of the input compressed air; a cylinder assembly 18 in which a piston assembly 23 is operably disposed having an air inlet 26 and outlet 27 on the wall of the tubular cylinder portion 19 which are in communication with the air passage holes of the valve body 10.

The above cited cylinder structure is operated in the following way: when input compressed air rushes via the inner hole 12 of the valve body 10 and flows to the front of the valve 11 so to push the same back into the inner side of the valve body 10, resulting in the blockage of the valve body 10; massive air is then led through the air passage 16 of the cylinder head plate 15 and exerts on the piston assembly 23 to complete a compression stroke. In the progression of the piston assembly 23, when the piston 24 moves within the range of the outlet 27 and the front most surface does not reach the boundary limit E of the outlet 27, as shown in FIG. 2, the air residued in the deep corner of the cylinder 19 will rush speedily outwardly via the still remained opening at the boundary limit E and further by way of the surrounding clearances of the cylinder 19 and the cylinder head plate 15 and then the valve body 10 into the side holes 14 of the valve body 10, resulting in the movement of valve 11 to block the air passage 16 of the cylinder head plate 15, and the valve 11 then accomplishes its movement in this operation. In the meanwhile, the piston 24 has moved over the boundary limit E and the air remained in the cylinder 19 is compressed and the so squeezed air then serves as a damper to absorb the impact of the piston 24, and the piston assembly 23 is stopped and backed off a little.

At this instant, the path from the inlet 12 of the valve body 10 to the air passage 16 of the cylinder head plate 15 is blocked, and the input compressed air is led to the inside of the valve body 10, resulting in the forward movement of the valve 11; and the air flows out of the valve body 10 via the hole 13, then further travels by way of the groove 17 and the groove on the surface of the cylinder portion 19 and then the air inlet 26 and finally into the cylinder portion 19 so as to push the piston assembly 13 back to the original point, i.e., near the cylinder head plate 15; and the expansion stroke is then completed.

On the piston assembly 23 approaching the above original point, the air will be squeezed into the air passage 16 to push the valve 11 back away from the opening of the passage 16 to its original position to complete an operation cycle. Repeatedly, the compressed air supplied externally will be input once again to carry out another cycle so as to make the piston rod 25 having a tool, such as a saw blade attached thereon, to move rapidly back and forth along with the piston assembly 23; and the tool can become useful in a practical working operation. Due to the smooth coordination between the outlet 27 and the piston assembly 23, there will be no dead points generated in practical operation, the tool will be operated in a smooth and secure manner.

However, the prior art pneumatically operated tool has a disadvantage of producing constant vibration and annoying noise to such a degree that the hands of the operator will become easily numb after a period of time in practical operation. The cause of the above cited problem is given as below; in a compression stroke, as shown in FIG. 2, some air between points E and F not being expelled in time from outlets 27 will rush into the groove 17 via the inlet 26, so the air left will not be powerful enough to slow down the forward movement of the piston assembly 23, and the piston surface 24A will come into collision with the end of the cylinder 19, resulting in the generation of vibration and noise. Moreover, in the expansion stroke, the other side of the piston 24B will collide with the cylinder head plate 15, and vibration and noise will also generate accordingly. Such vibration and noise taking place in a general pneumatically operated tool which runs at a speed more than 10,000 cycles/min. will certainly cause high frequency vibration and noise, and the operator's hands will feel numb and the working surrounding will be subject to sound annoyance. The piston 24 of the piston assembly 23 will be deformed or broken from countless times of collision, and must be replaced after a period of time. That forms the disadvantage of the prior art tool, and the present inventor aims to provide an improved cylinder structure which will solve the above cited problems.

SUMMARY OF THE INVENTION

The primary object of the present invention is to provide an improved cylinder structure for a pneumatically operated tool which is characterized in its two air tight chambers formed at the front and rear ends of the cylinder during the expansion and compression stroke respectively so that the air confined in the chambers can produce reaction pressure on the piston's front and rear face respectively, resulting in the reduction of impact and operation noise thereof.

One further object of the present invention is to provide an improved cylinder wherein the confined air in the air tight chambers at the front and rear ends of the cylinder can generate reaction pressure when squeezed on the piston so to make the same bounce back and forth more rapidly during the compression and expansion strokes, resulting in the increase of the output power thereof.

To better illustrate the structure and operation modes and features of the present invention, a number of drawings are given in company with a detailed description of a preferred embodiment, in which;

DETAILED DESCRIPTION OF THE PREFERRED EMBODIMENT

Figures 1, 2:
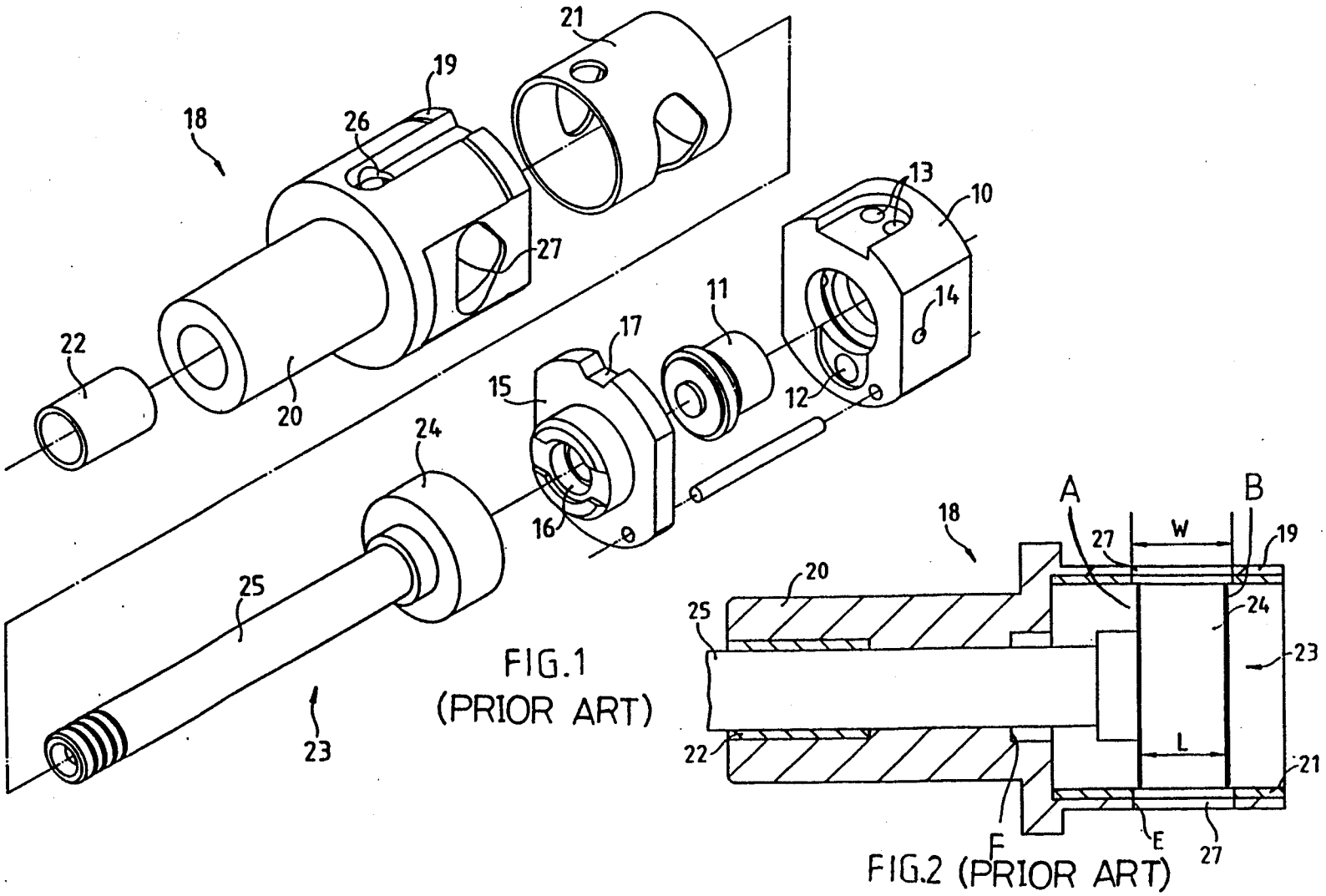
FIG.1 (PRIOR ART)
FIG.2 (PRIOR ART)
FIG. 1 is a diagram showing the exploded components of a prior art pneumatic tool.
FIG. 2 is a sectional diagram showing the prior art pneumatic tool.
Figure 3:
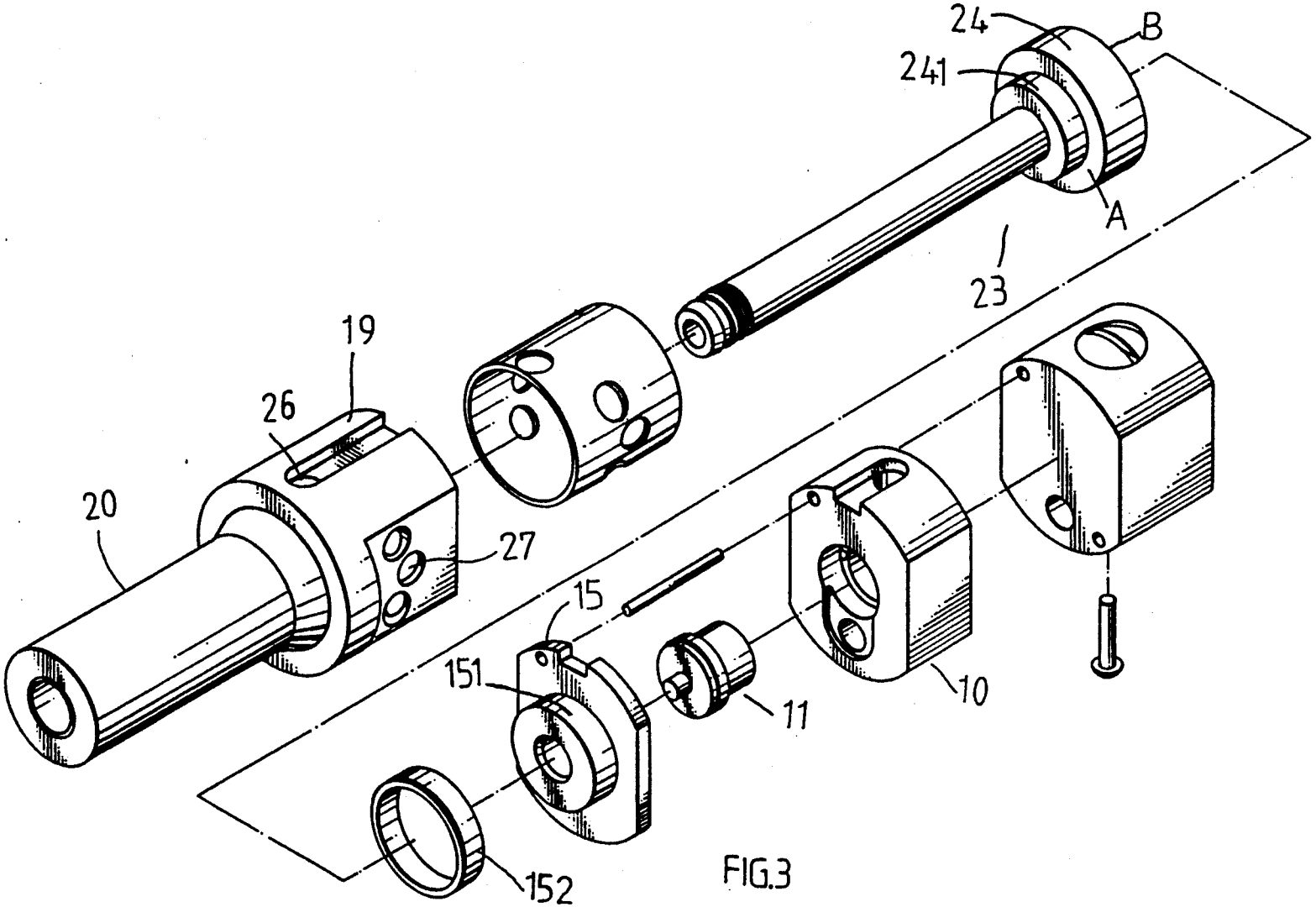
FIG. 3 is a perspective view of the exploded components of the present invention.
Figure 4:
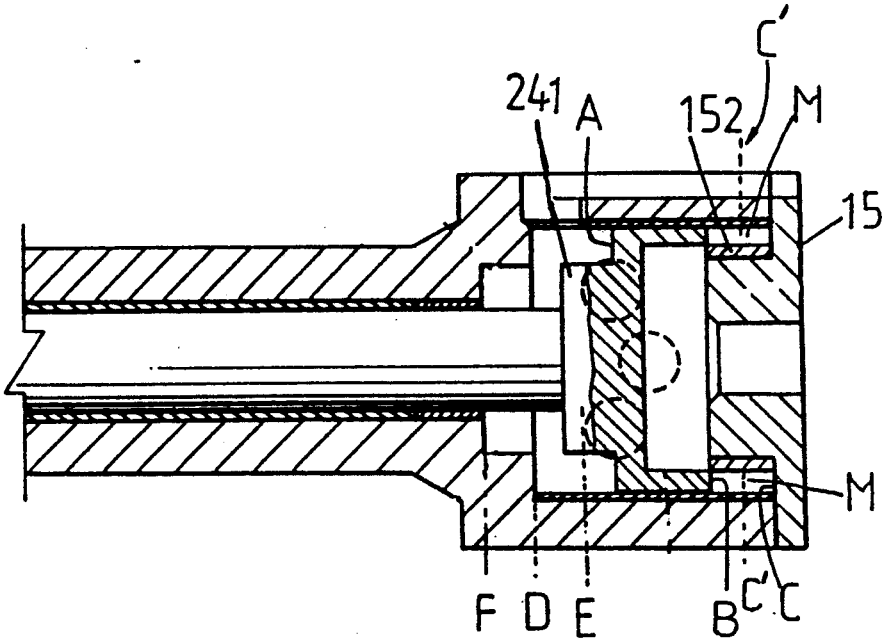
FIG. 4 is a sectional view showing the structure and operational mode of the present invention.

Referring to FIGS. 3, 4, the improved cylinder structure of a pneumatically operated tool of the present invention is shown wherein a cylindrical protrusion 151 is defined at a cylinder head plate 15 of the cylinder assembly with a sealing ring 152 of plastic material attached thereto. The front piston 24 of the piston assembly 23 is structured to have a cylindrical recess in conformity to the protrustion 151 so that the cylinder wall and the peripheral edge B of the piston 24 of the piston assembly 23 can form an air tight chamber M around the periphery of the protrusion 151 when the piston 24 is pushed to the top dead end in an expansion stroke, as shown in FIG. 4. The cylindrical extension 241 of the piston 24 is designed to have a diameter 3 mm larger than the prior art design, and the corresponding recess receiving the cylindrical extension 241 is also expanded in diameter by 3 mm so that the volume of the air confined in the area between points E and F is increased and the shock-absorbing capability is then advanced accordingly.

Figure 5:
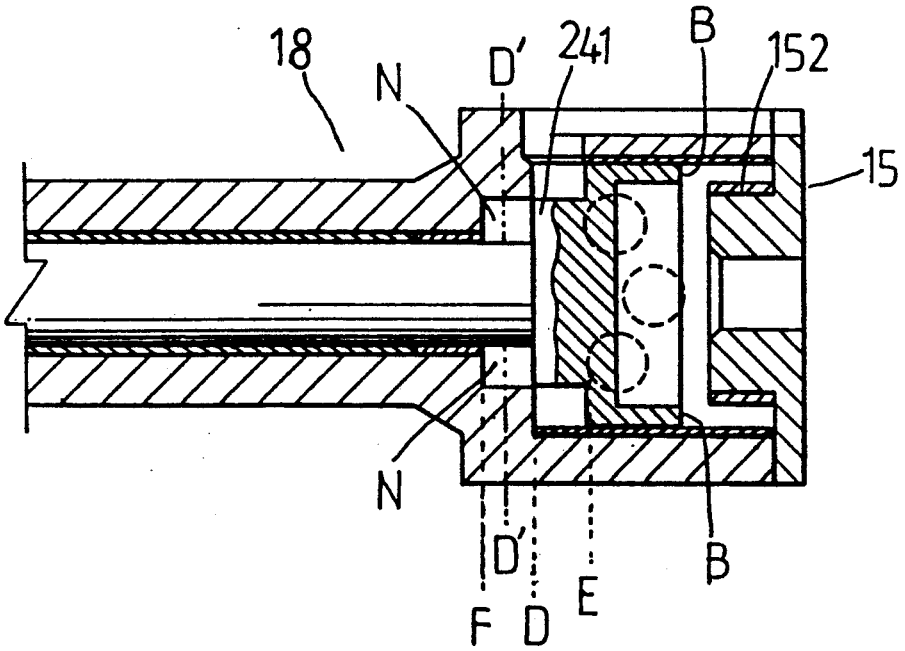
FIG. 5 is another sectional view thereof showing the structure and operational mode thereof.

Referring to FIG. 5, the air volume between points E and F is increased and the reaction pressure produced therein to serve as a buffer means against the movement of the piston assembly 23 is advanced. The chamber N defined between point d and point F can confine enough air to produce powerful reaction pressure to stop the movement of the piston assembly 23 at point D' and make the same bounce back a little thereat. At this moment, the course of the input compressed air has been changed due to the valve 11 and the compressed air is led via the air inlet 26 to start an expansion stroke; in the expansion stroke, as shown in FIG. 4, when the piston 24 comes near the cylinder head plate 15, the sealing ring element 152 attached to the cylindrical protrusion 151 can fit just in the inner recess of the piston 24 so that the peripheral edge B of the piston 24 can form an air tight chamber M with the cylinder head plate 15 (point C) around the periphery of the cylindrical protrusion 152. The reaction pressure produced in the peripheral chamber M can stop the movement of the piston 24 and make it back off a little at point C', at this instant, the course of the compressed air supply is varied by the valve 11 and the air flows via the air passage 16 to start another compression stroke.

As described in the preceding paragraphs, it becomes apparent that the air tight chambers N and M in the present invention can produce reaction pressure powerful enough to serve as a buffer or damper to decelerate the piston and further bounce back the same so that the piston will not collide directly with the ends of the cylinder, and no serious vibration or noise can be generated as the prior art pneumatically operated tool. Moreover, the chambers N and M can bounce back the piston rather effectively in the compression and expansion strokes, so the operation speed can be higher than the prior art tool and the output power is also increased, and the operation noise and vibration can also be improved.

I claim:

1. An improved cylinder structure for use in a pneumatically operated tool, said improved cylinder structure comprising:

a valve body (10) having a valve (11) slidably engaged along the axis of said valve body (10) for opening and closing a passage in said valve body (10);

said valve body (10) having air inlets and air outlets to actuate the opening and closing of said valve (11);

a cylinder head plate (15) having a first cylindrical protrusion (151) on a first side, a flat second side engaged to said valve body (10), and a passage (16) communicating with said passage in said valve body (10);

a cylinder assembly (18) engaged to said first side of said cylinder head plate (15);

said cylinder assembly (18) having a tubular cylinder portion (19) and a guide tube (20) integrally connected to said tubular cylinder portion (19);

said tubular cylinder portion (19) having a first cylindrical recess and air inlets and air outlets communicating with said air inlets and air outlets of said valve body;

a piston assembly (24) housed in said cylinder assembly (18) and said valve body (10) for reciprocal movement actuated by air pressure through said air inlets and said air outlets;

said piston assembly (24) having a cylindrical piston head slidably engaged in said first cylindrical recess of said tubular cylinder portion and a connection rod slidably engaged in said guide tube;

said piston head having a second cylindrical recess on a first side facing said first cylindrical protrusion (151);

said second cylindrical recess having a diameter substantially equal to a diameter of said first cylindrical protrusion (151);

wherein, during an expansion stroke of said piston assembly (24) said piston head slidably creates an air tight damper chamber (M) with said tubular cylinder portion (19) and said first cylindrical protrusion (151);

said piston head having a second cylindrical protrusion on a second side;

said second cylindrical protrusion having a diameter less than a diameter of said first cylindrical recess and substantially equal to a diameter of an extended end portion of said first cylindrical recess;

wherein, during a compression stroke of said piston assembly (24) said second cylindrical protrusion slidably creates an air tight damper chamber (N) within said extended end portion of said first cylindrical recess.

* * * * *